US007492279B2

(12) United States Patent
Uitto

(10) Patent No.: US 7,492,279 B2
(45) Date of Patent: Feb. 17, 2009

(54) SYSTEM FOR MANAGING BOREHOLE INFORMATION

(75) Inventor: Vesa Uitto, Tampere (FI)

(73) Assignee: Sandvik Mining and Construction OY, Tampere (FI)

( * ) Notice: Subject to any disclaimer, the term of this patent is extended or adjusted under 35 U.S.C. 154(b) by 194 days.

(21) Appl. No.: 10/552,168

(22) PCT Filed: Apr. 7, 2004

(86) PCT No.: PCT/FI2004/000214

§ 371 (c)(1),
(2), (4) Date: Oct. 11, 2005

(87) PCT Pub. No.: WO2004/090286

PCT Pub. Date: Oct. 21, 2004

(65) Prior Publication Data

US 2007/0035413 A1 Feb. 15, 2007

(30) Foreign Application Priority Data

Apr. 11, 2003 (FI) ..... 20030554

(51) Int. Cl.
*G01V 3/00* (2006.01)

(52) U.S. Cl. ..... 340/853.3; 340/854.6; 166/250.01

(58) Field of Classification Search ..... 340/854.6, 340/853.3; 166/250.01; 702/45, 5
See application file for complete search history.

(56) References Cited

U.S. PATENT DOCUMENTS

| | | | | |
|---|---|---|---|---|
| 4,570,718 | A | 2/1986 | Adams, Jr. | |
| 5,202,680 | A | 4/1993 | Savage | |
| 5,894,103 | A | 4/1999 | Shann | |
| 5,960,883 | A | 10/1999 | Tubel et al. | |
| 6,377,189 | B1 * | 4/2002 | Newman | 340/854.6 |
| 6,578,634 | B2 * | 6/2003 | Newman | 166/250.01 |
| 6,728,638 | B2 * | 4/2004 | Newman | 702/5 |
| 6,826,492 | B2 * | 11/2004 | Newman | 702/45 |
| 6,873,267 | B1 * | 3/2005 | Tubel et al. | 340/853.3 |
| 7,064,677 | B2 * | 6/2006 | Newman | 340/854.6 |

FOREIGN PATENT DOCUMENTS

| | | |
|---|---|---|
| EP | 0 367 495 | 5/1990 |
| EP | 1 083 298 | 3/2001 |
| WO | 01/69041 | 9/2001 |
| WO | 02/25319 | 3/2002 |

* cited by examiner

*Primary Examiner*—Albert K Wong
(74) *Attorney, Agent, or Firm*—Drinker Biddle & Reath LLP

(57) ABSTRACT

A method and a system for managing information relating to boreholes and further an identifier utilized by the method and the system. An identifier which includes machine-readable information is arranged in connection with a borehole under examination. The readable information may be an identification code or, alternatively, measurement information on the borehole to be stored in the identifier.

16 Claims, 3 Drawing Sheets

SYSTEM FOR MANAGING BOREHOLE INFORMATION

BACKGROUND OF THE INVENTION

The invention relates to a method of managing borehole information, the method comprising collecting and storing information on at least one borehole.

The invention further relates to a system for managing borehole information, the system comprising at least one control unit wherein borehole information is stored.

The invention yet further relates to an identifier for marking a borehole, the identifier comprising: a frame and means for fastening the identifier in connection with the borehole.

A rock drilling process produces a large amount of different information relating to boreholes. Drilling and charging plans may be provided before drilling. Further, information accumulated during drilling may be stored in a memory. In addition, boreholes may be measured after drilling in order to establish the result. Information is collected borehole-specifically. A problem is that disorganized information from different sources is difficult to manage.

BRIEF DESCRIPTION OF THE INVENTION

An object of the invention is to provide a novel and improved arrangement for managing information relating to boreholes.

The method of the invention is characterized by arranging at least one identifier, which includes machine-readable information, in connection with a borehole under examination, and by linking the stored information and the borehole under examination together by means of information read from the identifier.

The system of the invention is characterized in that the system comprises at least one identifier to be arranged in connection with a borehole under examination, that the identifier includes machine-readable information, and that the system is arranged to link the stored information and the borehole under examination together by means of information read from the identifier.

The identifier according to the invention is characterized in that the identifier comprises at least one machine-readable identification code.

The idea underlying the invention is that the identifier is arranged in connection with a borehole and it includes readable information on the borehole.

An advantage of the invention is that the identifier, in a reliable and relatively simple manner, makes it possible to ensure that the borehole information relates to a precisely correct borehole. This, in turn, makes the entire excavation process easier to manage. Furthermore, the invention improves the safety of an excavation process and makes it easier to automate.

The idea underlying an embodiment of the invention is that the identifier includes an identification code on the basis of which a single borehole is linked to data relating to the particular borehole. The data may be stored in the control unit of the system.

The idea underlying an embodiment of the invention is that the information included in the identifier is machine-readable in a remote manner.

The idea underlying an embodiment of the invention is that the identifier comprises at least one memory element wherein information can be stored.

The idea underlying an embodiment of the invention is that the identifier comprises at least one memory element wherein, in addition to an identification code, other information, such as borehole measurement information, information on drilling parameters used, rock type information, comments of an operator, or any other information necessary for post-drilling phases, can be stored.

The idea underlying an embodiment of the invention is that the identifier comprises a fastening element. This, without using any separate means, enables the identifier to be fastened in connection with a borehole.

The idea underlying an embodiment of the invention is that the frame of the identifier is tubular, which enables explosives, sealant material, various cartridges, measuring equipment, etc. to be inserted in a borehole therethrough. There is thus no need to extract the identifier e.g. for charging, and this speeds up the process. Furthermore, the identifier identifies the borehole uninterruptedly, so there is no risk of confusing the boreholes with one another. Furthermore, such an identifier may protect the mouth of a borehole against collapsing as well as prevent impurities from getting into the borehole.

The idea underlying an embodiment of the invention is that the identifier is arranged before drilling at a location according to a drilling plan, and that the borehole is drilled through the identifier. The identifier may be provided with an aperture to enable the drilling equipment to penetrate therethrough.

The idea underlying an embodiment of the invention is that a mine vehicle is equipped with means for arranging an identifier automatically in connection with a borehole under examination. It is then possible that a drilling unit includes means for arranging the identifier in connection with the borehole during drilling or immediately thereafter. It is also possible to equip a measuring device provided in the mine vehicle with means for arranging the identifier in connection with the borehole.

The idea underlying an embodiment of the invention is that a mine vehicle is equipped with a reader for reading information included in an identifier. The reader may be arranged e.g. in a rock drilling unit, in connection with a charging unit, or it may be arranged in a measuring boom provided in the mine vehicle.

The idea underlying an embodiment of the invention is that a mine vehicle is equipped with means for storing information in an identifier. The storing means may be arranged e.g. in connection with a rock drilling unit or a charging unit, or it may be arranged in a measuring boom provided in the mine vehicle.

BRIEF DESCRIPTION OF THE DRAWINGS

The invention is now described in closer detail in the accompanying drawings, in which FIG. 1 schematically shows a system of the invention for managing borehole information, FIG. 2 schematically shows measurement of a borehole, and a way in accordance with the invention of reading and storing information relating to the borehole, FIG. 3 schematically shows an identifier according to the invention, placed on a mouth of a borehole, as well as an arrangement for transmitting information between the identifier and a control unit in the system.

For the sake of clarity, the figures show the invention in a simplified manner. Like reference numerals identify like elements.

DETAILED DESCRIPTION OF THE INVENTION

Figure 1:
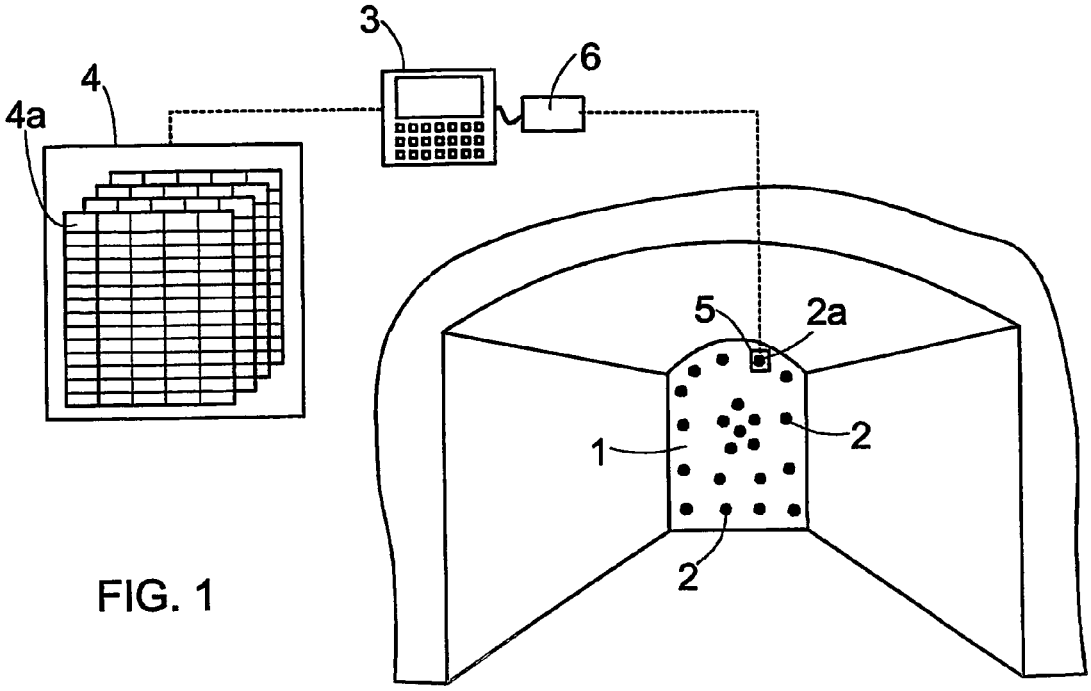

FIG. 1 illustrates a system of the invention for managing borehole information. Boreholes 2 are drilled in rock, in this case at the rear face 1 of a mine gallery, according to a predetermined drilling plan. The drilling plan may determine e.g. the number, location, direction and dimensions of boreholes as well as borehole identification information. Further, already at this stage, a blasting plan may be provided wherein the explosives, charge amounts and blasting caps to be used are determined. The drilling plan, together with other borehole information, may be stored in a control unit 3, which may be e.g. a computer or a corresponding device wherein the necessary information may be stored and wherein information may be processed. The control unit 3 may be a server, the information included therein being accessible to several devices associated with the excavation process. The control unit 3 may include a database 4 or the like wherein the information on the boreholes 2 may be stored in a suitable format, e.g. in a table format. In order to enable the information in the control unit 3 to be unambiguously linked with a single borehole, an identifier 5 is arranged in connection with the boreholes under examination, the information included in the identifier being readable to a reader 6 connected to the control unit 3. The information included in the identifier 5 may be an identification code to link a borehole 2*a* and a related file 4*a* together. On the other hand, in addition to the identification code, the identifier 5 may include e.g. measurement, drilling or rock type information, as will be described in closer detail below.

Figure 2:
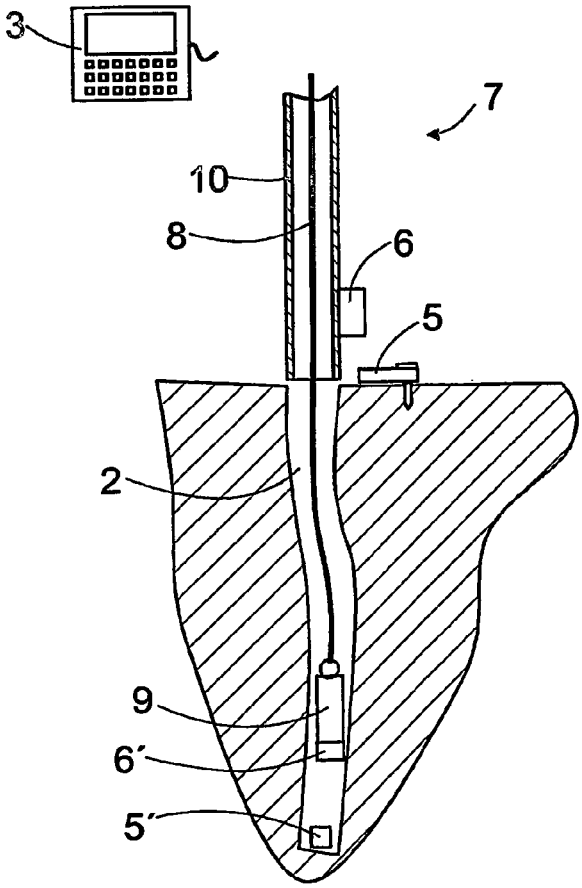

FIG. 2 shows an arrangement for measuring a borehole 2. The borehole 2 may be measured using a measuring device 7, which may comprise a sensor 9 to be inserted in the borehole 2 by means of a transmission element 8, and a frame 10. The sensor 9 may comprise e.g. an inclination sensor, an acceleration sensor, an electric compass, a GPS transceiver unit or a corresponding device, a geophysical sensor or another device suitable for measuring the borehole 2. Furthermore, the number of sensors 9 may be more than one, which enables several different measurements to be conducted simultaneously. The measuring device 7 may also comprise a control unit 3. The measuring device 7 may further comprise a reader 6 to read information, e.g. an identification code, included in an identifier arranged next to the borehole 2. The identification code enables measurement information collected during measurement to be related, in the control unit, precisely to the particular borehole 2. Information to be stored in the control unit may include e.g. the location coordinates, direction, straightness, length and diameter of a borehole as well as the geophysical characteristics thereof. The identifier 5 may also comprise one or more memory elements wherein information other than an identification code may also be stored. In such a case, the reader 6 of the measuring device 7 may comprise means for storing information in the memory element in the identifier 5. Measurement results may be stored in the identifier 5 either as such or after being processed in the control unit 3. Information obtained during measurement e.g. on the straightness or dimensions of a borehole, or rock type, etc., may be stored in the identifier 5. The identifier 5 is a physical object which may be fastened onto the surface of rock e.g. by means of an adhesive agent or fastening elements provided in the rock. Furthermore, the identifier 5' may be a physical object which may be dropped or pushed to the bottom of a borehole 2.

Figure 3:
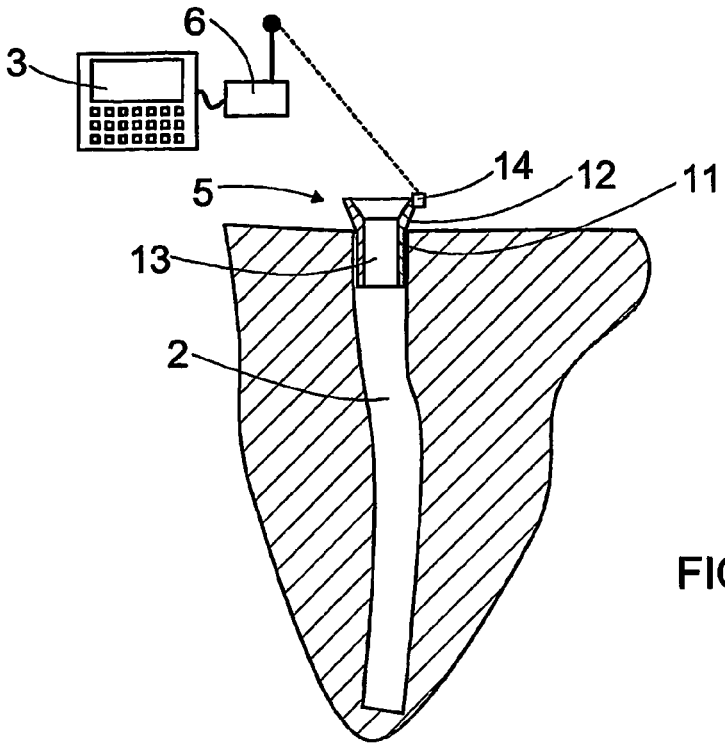

FIG. 3 shows an identifier 5 comprising an elongated, tubular frame 11 to enable the identifier to be at least partly inserted in a borehole 2. The frame 11 may further include a conical section 12 so that the identifier 5 becomes firmly wedged in the borehole 2. No separate fixing agents or devices are necessarily needed. Furthermore, it is possible to insert e.g. measuring sensors 9, charging or reinforcement material in the borehole 2 through an aperture 13 in the frame 11.

In FIG. 3, an identifier 5 comprises means for establishing a wireless connection between the identifier 5 and at least one control unit 3 included in the system. Data transmission may be implemented e.g. using radio waves, infrared beams or another suitable wireless solution. In order to enable a connection to be established, the identifier 5 is provided with at least one transmitter 14 while a reader 6 is provided with at least one receiver. For a bidirectional connection, the transmitter 14 in the identifier 5 and the receiver in the reader 6 may be replaced by transceivers. It is also possible to utilize the identifier 5 for positioning a drilling unit, a charging unit or the like.

Figure 4:
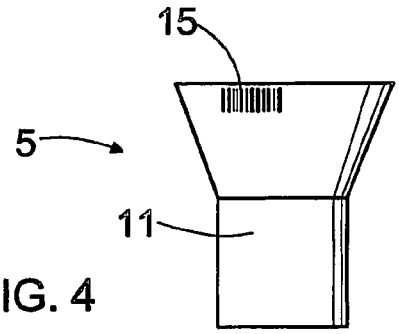
FIG. 4 is a schematic side view showing a second identifier according to the invention.
Figure 5:
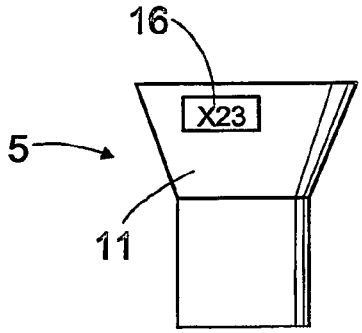
FIG. 5 is a schematic side view showing a third identifier according to the invention, FIG. 6 schematically shows a system, arranged in connection with a drilling unit, for reading information included in an identifier and for storing information therein, and FIG. 7 schematically shows a mine vehicle equipped with means for reading identifiers arranged in connection with boreholes.

FIG. 4 shows an identifier 5 comprising a visually readable identifier code; in this case a bar code 15. In FIG. 5, the bar code contains alphanumeric characters 16. In the identifier 5, such visual characters 15, 16 may be arranged on the outer surface of the frame 11 so that they can be machine-read by the reader 6. It is further to be noted that the design and shape of the frame 11 of the identifier 5 may differ from the solutions shown in FIGS. 4 and 5. The frame 11 of the identifier 5 may be made e.g. of a plastics material. Instead of a visually readable character, an electrically readable character, e.g. a magnetic tape, a microchip or the like, may also be used.

Figure 6:
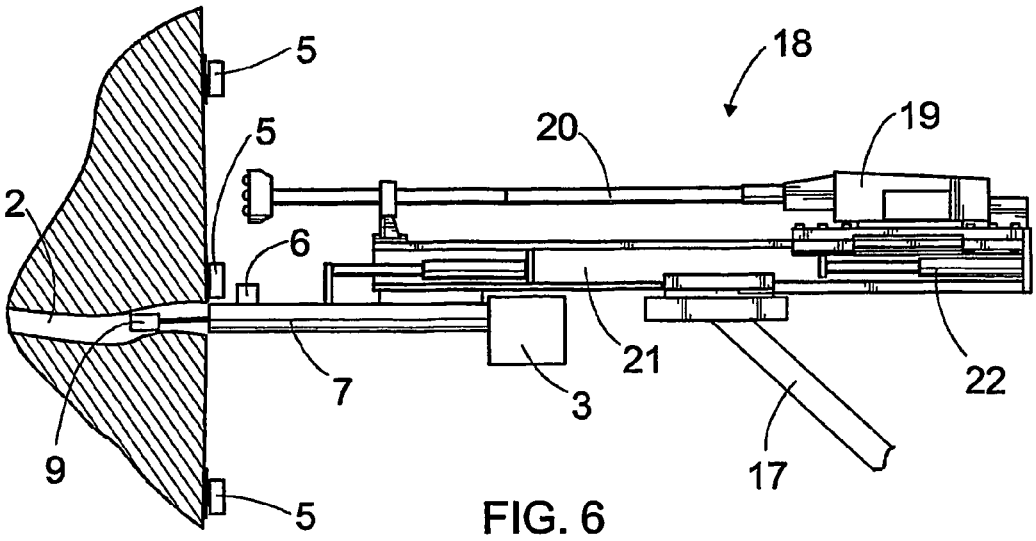

FIG. 6 shows a drilling unit 18 arranged in a boom 17 of a rock drilling rig, the drilling unit comprising e.g. a rock drill 19, a tool 20, a feeding beam 21 and a feeding device 22. The drilling unit 18 may further be equipped with a measuring device 7 to enable boreholes 2 to be measured after drilling. The measuring device 7 may be arranged at the front part of the feeding beam 21. The measuring device 7 is equipped with a reader 6 to read information included in an identifier 5. The identifiers 5 may be prearranged in locations according to the drilling plan. The identifiers 5 may be located on the basis of a separate measurement manually or e.g. by means of an automated measuring vehicle.

Figure 7:
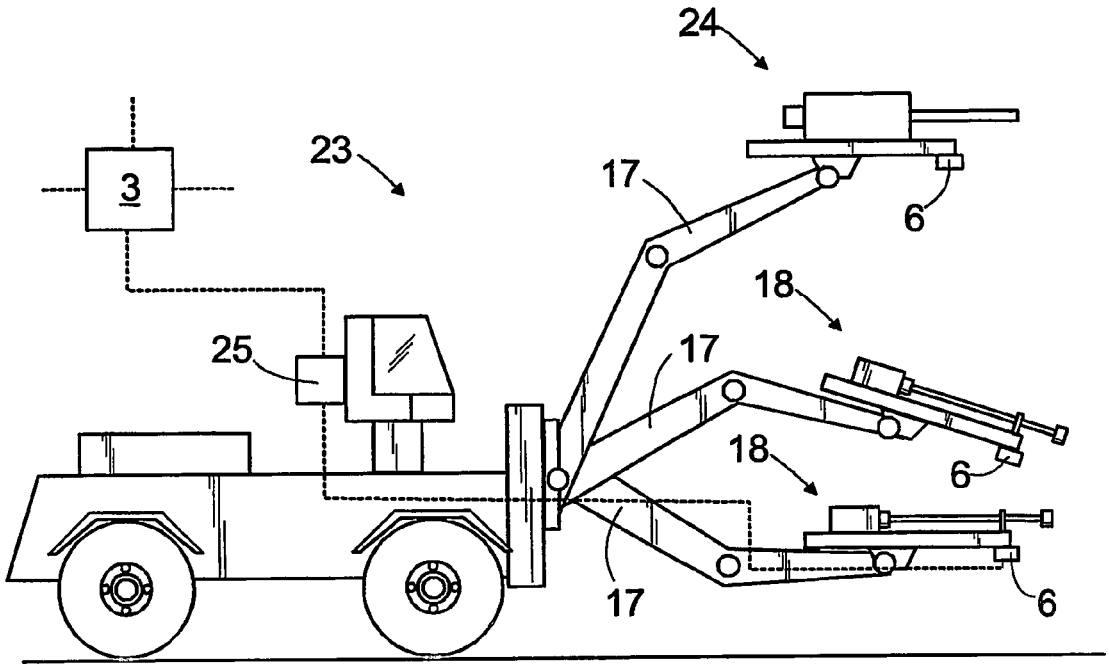

FIG. 7 shows a mine vehicle 23, which may comprise several booms 17. In the solution shown in the figure, the mine vehicle 23 comprises two drilling units 18 and one charging unit 24. One of the units may be equipped with a measuring device similar to that shown in FIG. 6. The mine vehicle 23 may further be equipped with a measuring boom equipped with a measuring device. The drilling units 18 and the charging unit 24 are equipped with readers 6. A reader 6 is arranged to read information included in an identifier 5. The reader 6 may be connected to a control device 25 of the mine vehicle 23, and the control device, in turn, may be connected to a control unit 3 of the system. The control unit 3 may be a server connected to the control devices of a plural number of mine devices and the units therein. When, for example, the reader 6 in the drilling unit 18 detects an identification code included in an identifier 5 fastened to the rock, the control unit 3 selects, on the basis of the identification code, the data related to the particular borehole at issue; the basic information in the data may have been provided while making the drilling plan. The control unit 3 may transmit information to the control device 25 of the mine vehicle 23 on the parameters to be used in drilling, such as information on the impact frequency, impact power, feed force, feed rate, rotation rate, flushing agent flow, drilling equipment to be used, etc. Similarly, the reader 6 in the charging unit 24 may read the identification code of the borehole to be charged, after which information may be delivered to the control device 25 of the mine vehicle 23 from the control unit 3 for charging. Borehole information relating to charging may include e.g. information about the location, direction, dimensions, quality and rock type of a borehole, as well as information relating to the blasting plan.

Furthermore, it is possible that the reader 6 stores information in a memory element included in an identifier 5. In such as case, information e.g. on the parameters used for drilling the borehole under examination, rock type information obtained during drilling, information on the dimensions of a borehole, etc., may be stored in the identifier. This information may be utilized e.g. when charging the borehole.

FIG. 2 further shows an alternative identifier 5' which may be arranged at the bottom of a borehole 2. A reader 6' may be provided in connection with a sensor 9 of a measuring device 7 to enable such identifiers 5' to be machine-read.

It is also possible to form different combinations of the above-disclosed identifiers.

The drawings and the related description are only intended to illustrate the idea of the invention. The details of the invention may vary within the scope of the claims.

The invention claimed is:

1. A method of managing and using borehole information, the method comprising:

collecting and storing information on at least one borehole in a control unit, arranging at least one identifier, which includes machine-readable information, in connection with a borehole under examination and in physical contact with rock, linking the stored information and the borehole under examination together by means of information read from the identifier, and using the borehole information and location of the identifier for controlling drilling or charging of at least one borehole.

2. A method as claimed in claim 1, comprising identifying the borehole under examination by reading an identification code included in the identifier, and linking the information relating to the borehole by using the identification code.

3. A method as claimed in claim 1, comprising identifying the borehole under examination by reading an identification code included in the identifier, linking the information relating to the borehole by using the identification code, storing information relating to the borehole in at least one control unit outside the identifier, and linking the information included in the control unit on the identifier together on the basis of the identification code.

4. A method as claimed in claim 1, comprising using an identifier comprising at least one memory element for storing information, and storing information relating to the borehole under examination in the identifier.

5. A method as claimed in claim 1, comprising using an identifier comprising at least one memory element for storing information, storing information relating to the borehole under examination in the identifier, measuring the borehole under examination by means of at least one measuring device which includes at least one sensor, measuring at least one of the following features: straightness of a borehole, dimensions of a borehole, rock type, and storing measurement information in the identifier.

6. A method as claimed in claim 1, comprising equipping a mine vehicle with a reader, identifying the borehole under examination by reading information included in the identifier by means of the reader, transmitting borehole information from a control unit in a system to a control device of the mine vehicle, and using the borehole information for controlling at least one drilling unit or charging unit of the mine vehicle.

7. A system for managing borehole information, the system comprising:

at least one control unit wherein borehole information for controlling drilling or charging of at least one borehole is stored, at least one identifier to be arranged in connection with a borehole under examination and in physical contact with rock, and wherein the identifier includes machine-readable information, and wherein the system is arranged to link the stored information and the borehole under examination together by means of information read from the identifier.

8. A system as claimed in claim 7, wherein the identifier comprises an elongated tubular frame ,and the tubular frame is inserted in a borehole.

9. An identifier as claimed in claim 7, the identifier comprises at least one memory element for storing information.

10. A system as claimed in claim 7 wherein the identifier comprises a transceiver for establishing a data transmission connection between the identifier and at least one external control unit.

11. An identifier as claimed in claim 7 wherein the identification code is a visually readable character.

12. A method of managing and using borehole information, the method comprising:

collecting and storing information on at least one borehole in a control unit, arranging at least one identifier, which includes machine-readable information, in connection with a borehole under examination and in physical contact with rock, linking the stored information and the borehole under examination together by means of information read from the identifier, equipping a mine vehicle with a reader, identifying the borehole under examination by reading information included in the identifier by means of the reader, transmitting borehole information from the control unit to a control device of the mine vehicle, and using the borehole information and location of the identifier for controlling at least one drilling unit or charging unit of the mine vehicle.

13. A method as claimed in claim 1 comprising:

using at least one identifier comprising an elongated tubular frame, inserting the tubular frame of the identifier in a borehole, inserting in the borehole through the tubular frame of the identifier at least one of the following: explosive, sealant material, cartridge, measuring equipment.

14. A method as claimed in claim 1, comprising:
fastening the identifier into the surface of rock.

15. A method as claimed in claim 1, comprising:
arranging the identifier in the bottom of a borehole.

16. A method as claimed in claim 1, comprising:
using at least one identifier comprising an elongated tubular frame, fastening the identifier before drilling onto the surface of rock according to a drilling plan, and using the identifier for drilling the borehole through the tubular frame of the identifier.

* * * * *